United States Patent [19]

Lasko

[11] Patent Number: 4,913,171

[45] Date of Patent: Apr. 3, 1990

[54] CIGARETTE AND METHOD OF MANUFACTURE

[76] Inventor: Leonard J. Lasko, 414 Texas St., San Francisco, Calif. 94107

[21] Appl. No.: 125,137

[22] Filed: Nov. 25, 1987

[51] Int. Cl.[4] ..... A24C 5/00; A24F 1/00

[52] U.S. Cl. ..... 131/360; 131/364; 131/365; 131/58

[58] Field of Search ..... 131/58, 365, 360, 364

[56] References Cited

U.S. PATENT DOCUMENTS

| | | | |
|---|---|---|---|
| 680,003 | 8/1901 | Simering | 131/58 |
| 1,104,779 | 7/1914 | Cooley | 131/365 |
| 2,323,867 | 7/1943 | Hood | 131/58 |
| 2,525,548 | 10/1950 | Herman | 131/58 |
| 3,385,302 | 5/1968 | Wattenford | 131/360 |
| 4,142,534 | 3/1979 | Brantl | 131/360 X |
| 4,226,249 | 10/1980 | Newman | 131/360 X |
| 4,319,588 | 3/1982 | Evans | 131/58 |

*Primary Examiner*—V. Millin
*Assistant Examiner*—Jennifer L. Doyle
*Attorney, Agent, or Firm*—Larry D. Johnson

[57] ABSTRACT

An improved cigarette and method of manufacture utilizes a specialized paper incorporating a narrow air tube portion along one of its longitudinal edges, and an elongated, generally rod-shaped rolling bar inserted into and through the air tube, used to roll up and capture tobacco spread over the paper's surface. The specialized cigarette paper incorporates a strip of small filter "flaps" into the construction of the air tube. The resultant cigarette emplaces the tobacco within a single, continuously spiraling envelope of cigarette paper about the central, longitudinal air-tube axis, with the filter flaps extending radially inward to filter the cigarette smoke.

8 Claims, ~~3~~ 4 Drawing Sheets

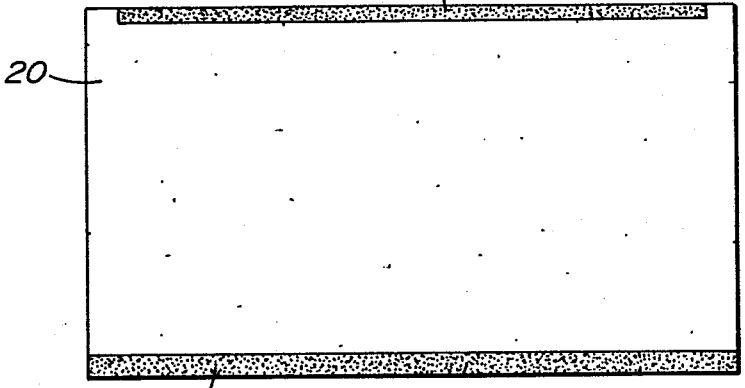
FIG._4
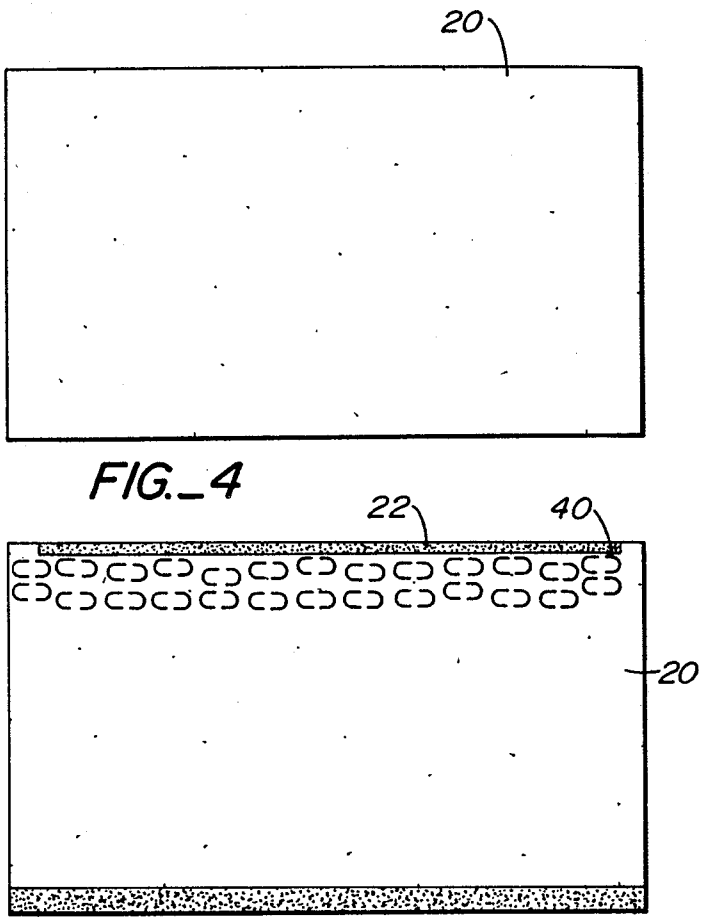
FIG._5
FIG._6
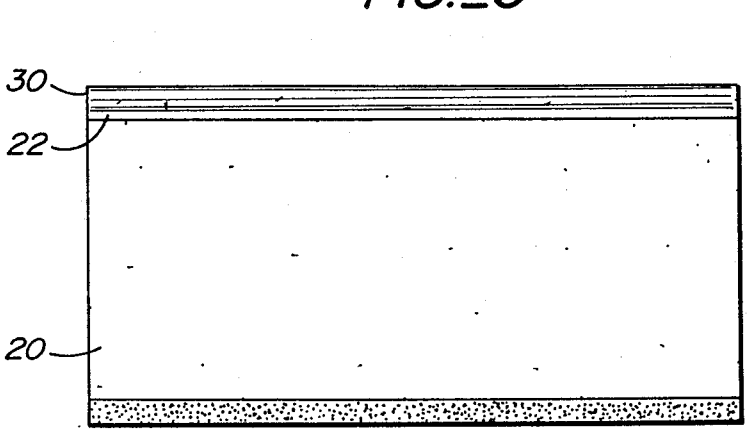
FIG._7

FIG._6-A

CIGARETTE AND METHOD OF MANUFACTURE

BACKGROUND OF THE INVENTION

1. Field of the Invention

This invention relates generally to cigarettes and other smoking articles, and more specifically to an improved structural design for a cigarette and cigarette paper, as well as an apparatus and method for the manufacture of such an improved cigarette.

2. Description of the Prior Art

Cigarette smoking has been and remains a popular activity for many people. Most modern cigarettes are made by the use of standard industrial, mass-production cigarette manufacturing machines using choice tobacco and fine cigarette paper, admittedly produce a generally high-quality, consistent cigarette. All known manufactured cigarettes are of a common physical structure; a quantity of tobacco homogeneously contained and dispersed throughout a cylindrical cigarette paper wrapper, with or without an integral, typically fibrous filter portion on one end. Such a structure for a cigarette may be common and accepted, but can be improved. Furthermore, such consistency in manufacture is evidenced by a specific, unmodifiable product once manufactured, resulting in considerable purchaser "trial and error" in searching for a satisfactory cigarette brand yielding the desired taste and degree of smoothness.

Most cigarette papers typically only provide the combustible wrapper to contain the enclosed tobacco. One distinguishing feature of many "manufactured" cigarettes (as opposed to consumer-rolled) is the quality, or even presence, of a cigarette filter, which is typically of a completely separate material and structure installed on one end of the finished cigarette. While filtering a cigarette provides many apparent advantages to the smoker, both in smoking satisfaction and health benefits, many non-commercial rolling machines do not accommodate such filters, nor are such filters readily available or conducive for manual attachment to a cigarette. Accordingly, most consumer-roller cigarettes are unfiltered, obviating such potential advantages of filtering.

Modern commercial cigarette manufacturing machines, while well-suited for mass production of large quantities of cigarettes, are typically bulky, complex and expensive devices, which are mechanically unsuitable for reduction in size for personal or consumer use. In addition, while there are several portable cigarette-rolling machines that have been developed for personal use, they are themselves still relatively bulky, are not conductive to carrying on the person, and do not easily produce a quality or consistent cigarette, minus trial, error, and practice.

SUMMARY OF THE INVENTION

The improved cigarette and method of manufacture of this invention provides a simple, effective apparatus for creating a new, structurally superior cigarette. The apparatus utilizes a specialized cigarette rolling paper comprising a generally rectangular sheet, which incorporates a narrow air tube portion along one of its longitudinal edges. An elongated, generally rod-shaped rolling bar is inserted into and through this cigarette paper air tube, so that the rolling bar contacts and frictionally engages the inside surface of the paper tube, and the rolling bar extends beyond both ends of the tube. This cigarette paper and rolling bar combination is then placed on a containment tray having a generally flat rolling surface, with respective ends of the rolling bar placed into complementary guide notches in the sides of the tray. A desired quantity of tobacco can then be applied to the upper, exposed surface of the cigarette paper, and preferably spread relatively evenly over its surface area. By turning the extended ends of the rolling bar in the appropriate direction, the rolling bar rotates about its longitudinal axis, frictionally engaging the cigarette paper air tube and causing the cigarette paper to roll up and capture the tobacco spread over its surface, forming a progressively larger cylinder. The turning motion, and resultant roll-up, is continued until the second longitudinal edge of the cigarette paper is drawn up to the created outside cylindrical surface of the forming cigarette, and a glue strip on the paper is moistened or applied to adhere this second edge to the side of the formed cigarette, cylinder, thus completing the construction of the cigarette and locking its structure in place. The rolled cigarette can then be lifted from the containment tray, and the rolling bar drawn through and removed from the air tube, now in the center of the formed cigarette.

The specialized cigarette paper used in this invention is a modification of standard, fine cigarette rolling paper. First, a generally rectangular piece of cigarette paper has a narrow glue strip applied along each of the opposite longitudinal edges of one of its surfaces. Next, a longitudinal strip of small filter "flaps" are cut, stamped, or otherwise incorporated into the paper along the paper's length, interior to and immediately adjacent only one of the applied glue strips. Finally, the edge of the paper bearing the filter flaps is folded over and its glue strip applied to the paper itself just interior of the filter flap portion strip. This foldover forms the requisite paper "tube" for accepting and engaging the aforementioned rolling bar. The filter flaps are thus contained entirely within this formed tube and, depending on the nature of their construction, are urged radially inward of the tube upon its formation.

The cigarette thus constructed from this specialized paper and by this apparatus comprises an elongated, cylindrical cigarette similar in outside appearance to a standard cigarette. However, in this construction, the tobacco is captured within a single, continuously spiraling envelope of cigarette paper about the central, longitudinal air-tube axis of the cigarette. This design enhances the structure of the finished cigarette by emplacing a paper-tobacco-paper symmetry throughout the cigarette's cross-section, and about the central air tube, rather than by merely encapsulating pure tobacco within a hollow cigarette paper cylinder, as in standard cigarettes.

Furthermore, the central air tube enables outside air passage into and through the length of the cigarette. The diameter of this passage, and thus the propensity for airflow, can be controlled before final manufacture by selection of the size of the foldover forming the air tube. The diameter can also be controlled after manufacture by the smoker himself, simply by manually squeezing the outside of the cigarette and distorting or even collapsing the central air tube.

Still further, the filter flaps incorporated into the air tube extended radially inward of the tube and act to interfere with, baffle, and filter the combusted gasses and smoke passing through the tube to the smoker. By appropriate design, these flaps can capture and remove substantial portions of the smoke, thus obviating the need for a separate, fibrous filter.

BRIEF DESCRIPTION OF THE DRAWINGS

FIG. 1 is an expanded perspective view of the machine;

FIG. 2 is a perspective view of the machine initiating a cigarette-rolling cycle; and FIG. 3 is a perspective view of the machine completing the cigarette-rolling cycle;

FIGS. 4–8 are views of a cigarette paper of this invention as used in the manufacture of a cigarette of this invention;

FIG. 4 is a plan view of a single sheet of the cigarette paper before modification for this invention;

FIG. 5 is a plan view of a single sheet of the cigarette paper with a pair of glue strips laid down on one surface;

FIG. 6 is a plan view of a single sheet of the cigarette paper with a longitudinal strip of filter flaps installed;

FIG. 6*a* is an enlarged plan view of the filter flaps portion of the cigarette paper;

FIG. 7 is a plan view of a single sheet of the completed cigarette paper with an air-tube portion having been formed; and FIG. 8 is an elevated vertical cross-sectional view of the air tube portion of the completed cigarette paper, with the filter flaps extending radially inward of the air tube.

FIG. 9 is a perspective view of the completed cigarette; and

FIG. 10 is an elevated horizontal cross-sectional view of the completed cigarette.

DETAILED DESCRIPTION OF A PREFERRED EMBODIMENT

Figure 1:
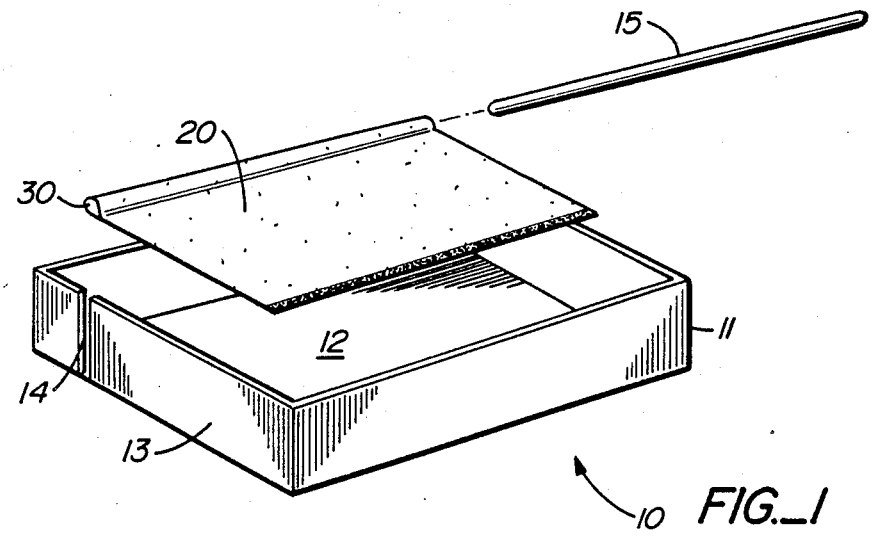
FIGS. 1–3 are views of a simplified version of a cigarette-making of this invention.
Figure 2:
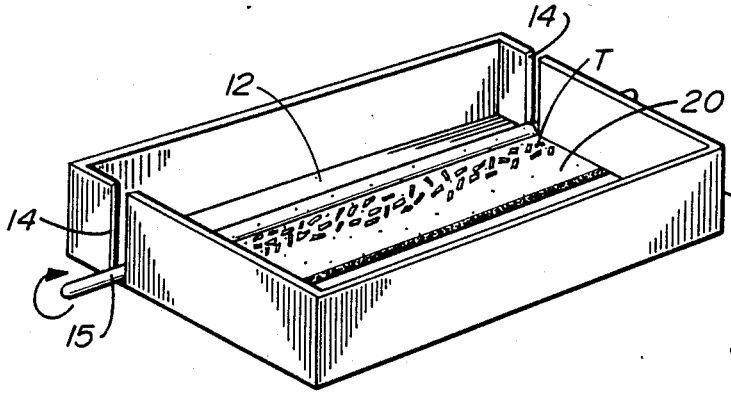
Figure 3:
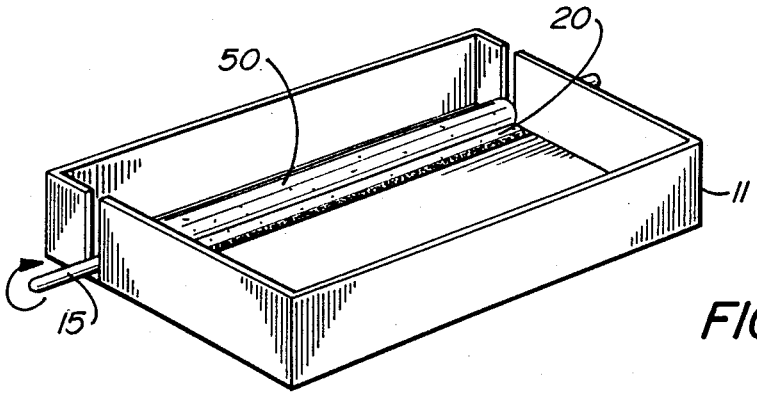

FIGS. 1–3 are views of a simplified version of a cigarette-making machine of this invention. FIG. 1 is an expanded perspective view of a machine 10, comprising containment tray 11 having a generally flat rolling surface 12 bounded by walls 13. At least two opposing walls each bear a guide notch 14, extending down the wall to rolling surface 12. Rod or rolling bar 15 is extendable into air tube 30 of cigarette paper 20, as described infra.

FIG. 2 is a perspective view of the machine initiating a cigarette-rolling cycle. Here, rolling bar 15 has been extended through the air tube of paper 20, and placed within guide notches 14 so that the paper rests on rolling surface 12. A quantity of tobacco T is placed on the surface of the paper 20, and the rolling bar 15 is rotated in the direction indicated.

FIG. 3 is a perspective view of the machine completing the cigarette-rolling cycle. By continued rotation of the rolling bar 15, the cigarette paper 20 has been completely rolled up to capture the tobacco within the formed cigarette 50.

FIGS. 4–8 are views of a cigarette paper 20 of this invention as used in the manufactured of a cigarette of this invention. FIG. 4 is a plan view of a single sheet of cigarette paper 20 before modification for this invention.

FIG. 5 is a plan view of a single sheet of the cigarette paper 20 with a pair of glue strips laid down on one surface. An air tube glue strip 22 is placed along one longitudinal edge of the paper 20, preferably terminating just short of the ends of the edge (this permits a slight "flaring" of the air tube when formed, enabling easier insertion of the rolling bar). Final sealing glue strip 24 is placed on the other longitudinal edge of the paper, and preferably extends the entire length of the edge.

FIG. 6 is a plan view of a single sheet of the cigarette paper 20 with a longitudinal strip of filter flaps 40 installed. These flaps are preferably installed immediately adjacent air tube glue strip 22.

FIG. 6*a* is an enlarged plan view of the filter flaps 40 portion of the cigarette paper 20. Filter flaps 40 can be formed by an elongated, semi-circular cut line 42 through the paper, and placement of a curved fold line 44 connecting the ends of cut line 42. The formed flaps may be arranged in a staggered, opposing arrangement as illustrated.

FIG. 7 is a plan view of a single sheet of the completed cigarette paper 20 with an air-tube portion 30 having been formed in the paper by folding of the air tube glue strip 22 over on to the paper. Thus, the filter flaps are wholly contained within the air tube 30.

Figure 8:
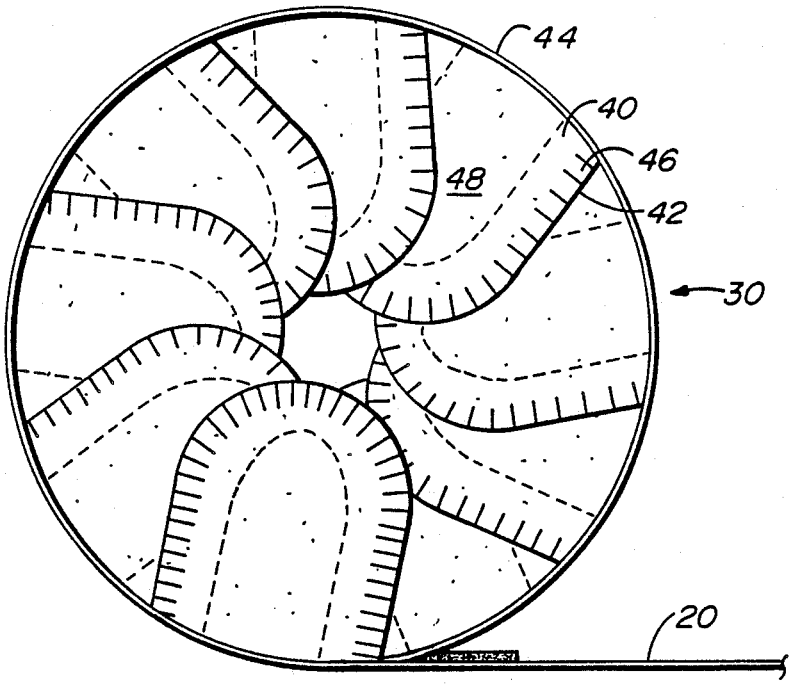

FIG. 8 is an elevated vertical cross-sectional view of the air tube portion 30 of the completed cigarette paper 20, with the filter flaps 40 extending radially inward of the air tube. This radial extension is encouraged by the effect of the curved fold line 44 when the air tube is formed. The filter flaps 40 may also include a feathered edge 46 adjacent the cut line 42, and a depression area 48 interior of the cut line. Either or both of these latter features enhance the filtering effect of the filter flaps. For example, the feathering of the edges causes non-laminar flow of the moving cigarette smoke, which enhances separation of the particulates from the smoke and into the filter flaps. In addition, the increased surface area created by the feathering of the flap edges increases the ability of the cigarette paper to absorb materials in the smoke. Furthermore, the depression area can act as a trap for particulates and ashes moving with the smoke. Still further, depending upon the specific arrangement of the filter flaps, a spiralling or centrifugal effect may be created in the moving smoke, adding to the effectiveness of these integral filter flaps.

Figure 9:
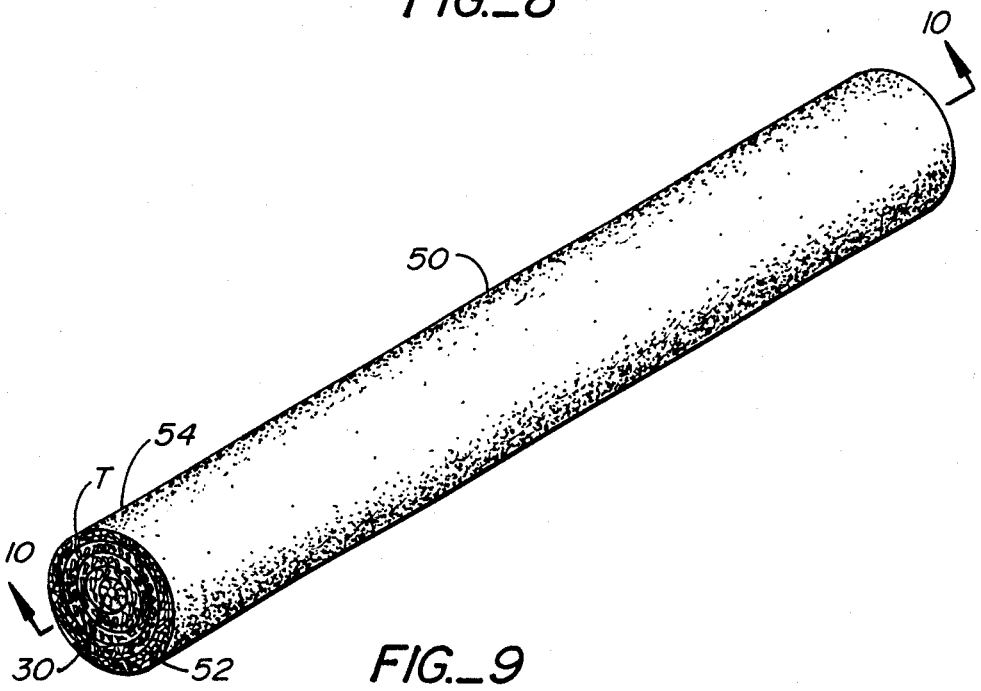
FIGS. 9 and 10 are views of a completed cigarette as manufactured according to this invention.
Figure 10:
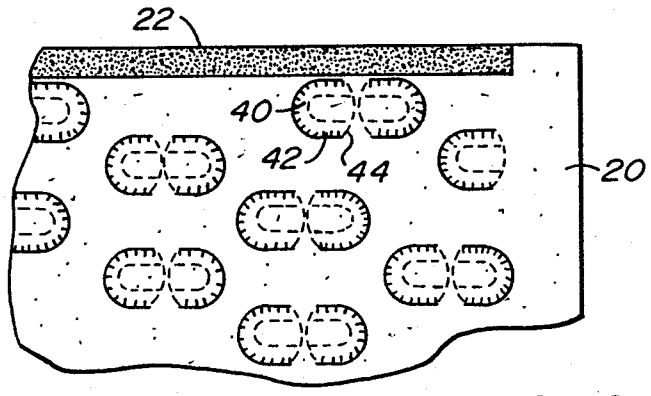
Figure 10:
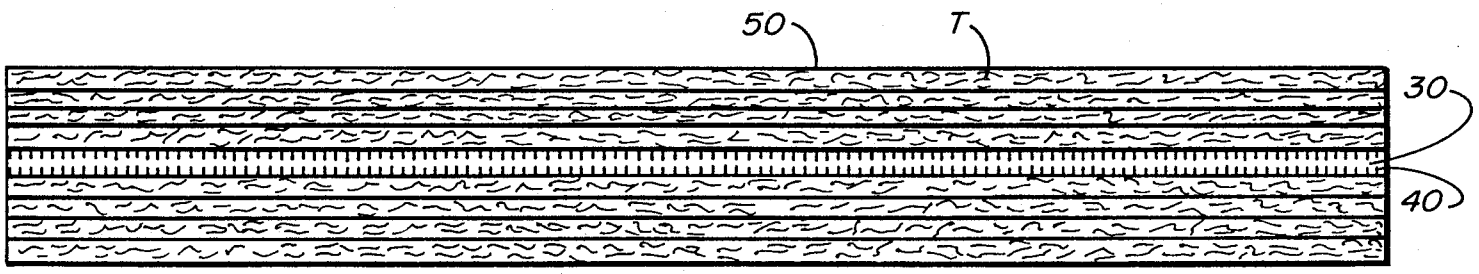

FIGS. 9 and 10 are views of a completed cigarette as manufactured according to this invention. FIG. 9 is a perspective view of the completed cigarette 50, illustrating the continuous paper spiral 52 formed between the outside surface of central air tube 30 and the inside surface of external cigarette wrapper 54, with tobacco T dispersed throughout.

FIG. 10 is an elevated horizontal cross-sectional view of the completed cigarette 50. This view illustrates the alternating paper-then-tobacco arrangement of the cigarette, and the radially inward orientation of filter flaps 40 within central air tube 30.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An improved cigarette comprising:

an elongated paper cylinder having an outside surface and an inside surface, and an interior volume, said interior volume having a longitudinal axis;

a generally hollow central air tube portion having an inside surface and an outside surface, said air tube extending along said interior volume longitudinal axis and including a plurality of filter flap members extending generally radially inward from said air tube inside surface; and a paper layer defining a diminishing-radius spiral extending from said paper cylinder inside surface to said central air tube outside surface, wherein a smoking substance is captured adjacent said paper layer and between said paper cylinder inside surface and said central air tube outside surface.

2. The improved cigarette of claim 1 wherein said filter flap members are formed by elongated, semicircular cut lines through said central air tube.

3. The improved cigarette of claim 2 wherein said filter flaps include an edge portion and an interior portion, and said edge portion includes a feathered edge and said interior portion includes a depression area.

4. An improved cigarette paper comprising:

a generally rectangular sheet having a top surface and a first and second longitudinal edge;

a first adhesive strip applied adjacent said first longitudinal edge;

a second adhesive strip applied adjacent said second longitudinal edge; and a plurality of filter flaps incorporated into said paper adjacent said first adhesive strip, so that said first longitudinal edge can be folded over onto said sheet top surface to form a tube, and said filter flaps are captured within said tube.

5. The improved cigarette paper of claim 4 wherein said filter flaps comprise flap portions extending radially inward of said tube.

6. The improved cigarette paper of claim 5 wherein said flap portions have edge portions and interior portions, and said edge portions include a feathered edge, and said interior portions include depression area.

7. The improved cigarette paper of claim 4 wherein said filter flaps are arranged in a staggered, opposed relationship.

8. The improved cigarette paper of claim 4 wherein said first adhesive strip extends less than the entire length of said first longitudinal edge, and said second adhesive strip extends the entire length of said second longitudinal edge.

* * * * *